US010335699B2

(12) United States Patent
Kwan

(10) Patent No.: US 10,335,699 B2
(45) Date of Patent: Jul. 2, 2019

(54) CAR TYPE MODEL

(71) Applicants: GATEWAY AUTOART LIMITED, Tsuen Wan (CN); GATEWAY AUTOART JAPAN CORPORATION, Fuefuki-shi (JP)

(72) Inventor: Kelvin Yuetming Kwan, Tsuen Wan (CN)

(73) Assignees: GATEWAY AUTOART LIMITED, Hong Kong (CN); GATEWAY AUTOART JAPAN CORPORATION, Yamanashi (JP)

( * ) Notice: Subject to any disclaimer, the term of this patent is extended or adjusted under 35 U.S.C. 154(b) by 0 days.

(21) Appl. No.: 15/919,697

(22) Filed: Mar. 13, 2018

(65) Prior Publication Data

US 2019/0160386 A1 May 30, 2019

(30) Foreign Application Priority Data

Nov. 28, 2017 (JP) ..... 2017-227956

(51) Int. Cl.
*A63H 17/26* (2006.01)
*A63H 17/00* (2006.01)
*A63H 19/00* (2006.01)

(52) U.S. Cl.
CPC ..... *A63H 17/262* (2013.01); *A63H 17/002* (2013.01)

(58) Field of Classification Search
CPC .... A63H 17/00; A63H 17/002; A63H 17/004; A63H 17/02; A63H 17/25; A63H 17/26;
(Continued)

(56) References Cited

U.S. PATENT DOCUMENTS 4,693,693 A * 9/1987 Kennedy ..... A63H 17/02 446/470
4,986,789 A * 1/1991 Hang ..... A63H 17/004 434/259

(Continued)

FOREIGN PATENT DOCUMENTS

CN 201033252 Y 3/2008
CN 201216877 Y 4/2009

(Continued)

OTHER PUBLICATIONS

European Search Report dated Oct. 4, 2018 in counterpart European Patent Application No. 18161848.9.

(Continued)

*Primary Examiner* — Kien T Nguyen
(74) *Attorney, Agent, or Firm* — Ladas & Parry LLP

(57) ABSTRACT

[Problems to be Solved] The present invention has been made to solve such a problem and has an object to enable a more enhancement in opening/closing stability of left and right doors in reliable abutment of a bottom area provided under the doors of a body formed by a resin on a reinforcing member formed of a metal in an ornamental minicar configured to fix the reinforcing member formed of a metal to the body having the doors configured openably.
[Means for Solution] A reinforcing member 20 formed of a metal is fixed to a body 10 formed by a resin to which left and right doors 12 are to be attached openably, and a bottom portion 16 positioned under the doors 12 is fixed to a frame portion 29 of the reinforcing member 20. Consequently, the body 10 is molded by a resin to easily enable processing of a fine part, and at the same time, the body 10 (particularly, a side sill member 13 portion positioned directly under the door 12) is caused to be flexed with difficulty by the reinforcing member 20 formed of a metal. Thus, it is possible to enable opening/closing stability of the door 12 to
(Continued)

be exhibited and to enable a massive feeling to be exhibited when a user performs holding in a hand.

7 Claims, 8 Drawing Sheets

(58) Field of Classification Search
CPC .... A63H 17/262; A63H 17/264; A63H 29/00; A63H 29/24; A63H 19/00; A63H 19/22
USPC ..... 446/93, 117, 127, 470, 471
See application file for complete search history.

(56) References Cited

U.S. PATENT DOCUMENTS 5,083,969 A 1/1992 Wagener
5,791,967 A * 8/1998 Yeh ..... A63H 17/25 446/279
6,565,411 B1 * 5/2003 Fosbenner ..... A63H 29/24 446/464
6,918,627 B2 * 7/2005 Mataja ..... B62K 9/00 296/177
6,988,929 B2 * 1/2006 Wong ..... A63H 29/08 446/462
2017/0014724 A1 1/2017 Kwan

FOREIGN PATENT DOCUMENTS

DE 867071 C 2/1953
WO 2016059811 A1 4/2016

OTHER PUBLICATIONS

Japanese Office dated Oct. 23, 2018 in counterpart Japanese Patent Application No. 2017-227956.
Computer generated English translation of German Patent DE867071C.
Computer generated English translation of Chinese Patent CN201033252Y.
Computer generated English translation of Chinese Patent CN201216877Y.
Computer generated English translation of WIPO Patent Publication Application WO2016059811.

* cited by examiner (a)

(b)

CAR TYPE MODEL

TECHNICAL FIELD

The present invention relates to a car type model.

BACKGROUND ART

Conventionally, a car type model (a minicar) is broadly popular as a toy for children or as ornaments which can be endured to see by adults. The ornamental minicar is a commercial product for a user who wants to take a look and enjoy beauty of the minicar and wants to keep at least a shape of a desirable car at a hand. For this reason, it is demanded to finely fabricate the minicar in order to intimate an authentic car as greatly as possible. Therefore, there are offered minicars for ornamental purpose which really reproduce authentic cars from exterior decors to interior decors.

Referring to the ornamental minicar of this kind, moreover, a user enjoys beauty given when placing and seeing the minicar, and furthermore, actually picks up the minicar by a hand to experience a massive feeling and enjoys the minicar by opening a door or the like. For this reason, the ornamental minicar is often manufactured by die casting using a metal such as an alloy or brass in order to exhibit the massive feeling or opening/closing stability.

The die casting is a method of causing a molten alloy to flow into a precision mold made of a metal by applying pressure, thereby performing casting. Since a cast metal thus manufactured has high dimension accuracy, the die casting is suitable for mass production of products under the same standard. However, a shape in every fine part of the ornamental minicar cannot be molded by the die casting and the fine part is to be processed after pull-out of the mold. Conventionally, it is necessary to carry out the processing manually by a skilled worker. For this reason, there is a problem in that the ornamental minicar cannot be mass-produced and a manufacturing cost is increased.

On the other hand, referring to a minicar formed of a resin which is often used as a material of a model, it is possible to process a fine part much more easily than a minicar formed of a metal. Consequently, it is also possible to reduce a manufacturing cost. However, the minicar formed of a resin has no massive feeling when it is held in a hand, and gives a tawdry impression. Moreover, the resin is apt to be flexed by slight force so that opening/closing stability related to an opening/closing portion such as a door or a hood is also damaged by the flexure. In some cases, furthermore, the opening/closing portion is not closed properly due to aging degradation of the resin.

In order to solve such a problem, conventionally, there is known an ornamental minicar in which left and right doors attached to a body formed by a resin are openably configured and a reinforcing member formed of a metal is fixed to the body (see Patent Document 1). According to the minicar described in the Patent Document 1, it is possible to cause the body to be flexed with difficulty by the reinforcing member formed of a metal while molding the body by the resin so as to easily enable the processing of a fine part and to exhibit a massive feeling when a user holds the minicar in a hand. In particular, the minicar described in the Patent Document 1 has such a structure that the reinforcing member formed of a metal abuts on a side sill to be a portion positioned under the doors of the body. For this reason, the side sill portion is flexed with difficulty when the door is to be opened/closed. Consequently, it is possible to enhance the opening/closing stability of the door.

PRIOR ART DOCUMENT

Patent Document

[Patent Document 1] WO2016/059811 Publication

SUMMARY OF THE INVENTION

Problems to be Solved

In a process for manufacturing a body formed by a resin with use of a metal mold, there is a tendency that a shape of a lower part (a bottom area) of the body is deformed outward when removing the molded body from an inner core of the metal mold. FIG. 8 is a view showing a process in which the shape of the bottom area is deformed. For easy understanding of the explanation, the shape is schematically shown with exaggeration.

FIG. 8(*a*) shows a state in which movable side plates 201 to 203 are separated in directions of arrows respectively so that the body 100 is exposed after a molten resin is injected into a cavity to be formed between a fixed side plate (an inner core) 200 and the movable side plates 201 to 203 in three directions so that a body 100 made of a resin is formed. FIG. 8(*b*) shows an intermediate state in which the body 100 exposed as shown in FIG. 8(*a*) is pulled out toward an upper part of the inner core 200.

An almost central part of the inner core 200 is a portion for molding a central shape of a side surface of the body 100 and is slightly swollen outward. In contrast, a lower part of the inner core 200 is provided for molding the bottom area of the body 100 and is narrowed inward from a central part of the side surface. For this reason, the whole side surface of the body 100 is expanded outward when the bottom area passes through the central part of the inner core 200 at the step of upward pulling the body 100 out of the inner core 200. Also after the body 100 is pulled out of the inner core 200, then, the side surface of the expanded body 100 does not completely return into an original state so that the bottom area is molded in an outward deforming condition.

A side sill to be a portion positioned under the door of the body 100 is present in the bottom area of the body 100. For this reason, there is a problem in that the reinforcing member formed of a metal and provided on an inside of the body 100 abuts on the side sill with difficulty if the shape of the bottom area is deformed outward.

The present invention has been made to solve such a problem and has an object to enable a more enhancement in opening/closing stability of left and right doors in reliable abutment of a bottom area provided under the doors of a body formed by a resin on a reinforcing member formed of a metal in an ornamental minicar configured to fix the reinforcing member formed of a metal to the body having the doors configured openably.

Means for Solving the Problems

In order to solve the problem, the reinforcing member formed of a metal is fixed, from an inside, to a body formed by a resin to which the left and right doors are to be openably attached in a car type model according to the present invention. The reinforcing member has a frame portion to which a bottom portion positioned under the doors of the body is to be fixed.

Effect of the Invention

According to the present invention having the structure described above, it is possible to cause the body to be flexed with difficulty by the reinforcing member formed of a metal while molding the body with a resin so as to easily enable the processing of a fine part. Therefore, it is possible to exhibit the opening/closing stability related to the doors. Even though in the case in which the bottom portion positioned under the doors of the body is molded to be outward expanded at the step of manufacturing the body, particularly, the bottom portion is fixed to the reinforcing member formed of a metal. Therefore, the bottom portion positioned under the doors reliably abuts on the reinforcing member formed of a metal. Consequently, the bottom portion is flexed with difficulty when the doors are to be opened/closed. Thus, the opening/closing stability related to the doors can be enhanced more greatly.

BEST MODE FOR CARRYING OUT THE INVENTION

Figure 1:
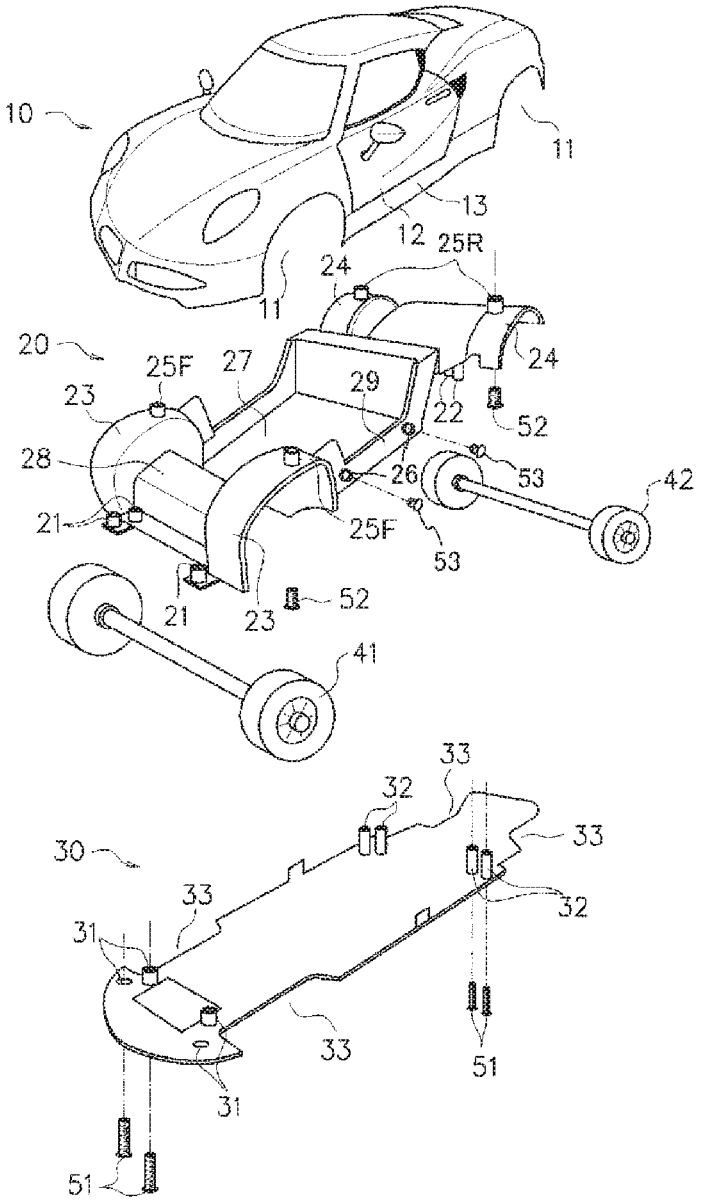
FIG. 1 is an exploded view showing an example of a structure of a car type model (a minicar) according to the present embodiment.
Figure 2:
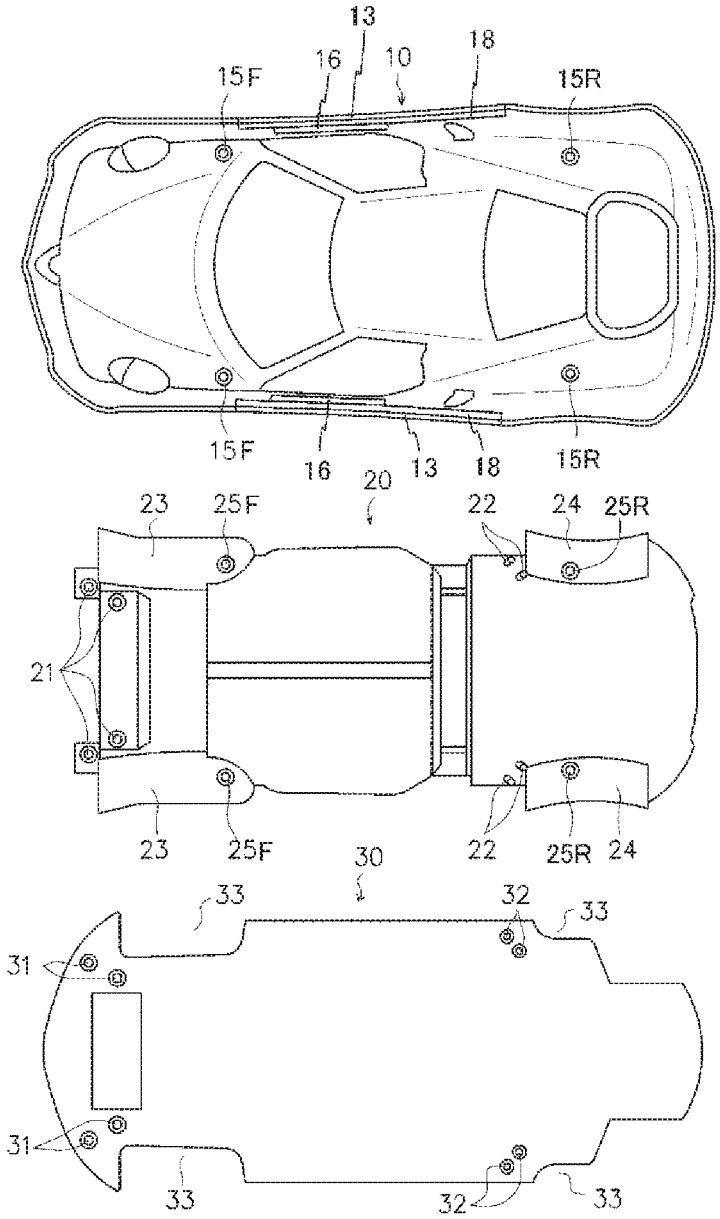
FIG. 2 is a view showing a state in which a body, a reinforcing member and a chassis in the minicar are seen from a back face according to the present embodiment.

An embodiment according to the present invention will be described below with reference to the drawings. FIG. 1 is an exploded view showing an example of a structure of a car type model (a minicar) according to the present embodiment. Moreover, FIG. 2 is a view showing a state in which a body 10, a reinforcing member 20 and a chassis 30 in a minicar are seen from a back face according to the present embodiment.

As shown in FIG. 1, the minicar according to the present embodiment includes the body 10 formed of a resin, the reinforcing member 20 formed of a metal, and the chassis 30 formed of a resin and is configured to assemble them with a plurality of fixing screws 51, 52 and 53 (an example of a fixing member). Herein, the chassis 30 is fixed to the reinforcing member 20 with the fixing screw 51, and the reinforcing member 20 is fixed to the body 10 with the fixing screw 52.

In other words, a plurality of screw fastening holes 31 and 32 is provided on the chassis 30. In the present embodiment, four screw fastening holes 31 are provided on both of left and right sides at a front side of the chassis 30 and four screw fastening holes 32 are provided on both of left and right sides at a rear side thereof. All of these screw fastening holes 31 and 32 are through holes.

Moreover, the reinforcing member 20 has a plurality of screw fastening holes 21 and 22 corresponding to the screw fastening holes 31 and 32 provided in the chassis 30, respectively. In other words, four screw fastening holes 21 are provided on both of left and right sides at a front side of the reinforcing member 20 and four screw fastening holes 22 are provided on both of left and right sides at a rear side thereof. Although the screw fastening holes 21 on the front side are through holes, the screw fastening hole 22 at the rear side is a stop hole. Consequently, the chassis 30 is fixed to the reinforcing member 20 with the fixing screws 51.

By insertion of a plurality of fixing screws 51 into the screw fastening holes 31 and 32 of the chassis 30 and the screw fastening holes 21 and 22 of the reinforcing member 20, the chassis 30 is fixed to the reinforcing member 20 with the fixing screws 51.

The chassis 30 has a notch portion 33 on both of the left and right sides at the front side and both of the left and right sides at the rear side. The notch portion 33 is cut inward in a width direction, and four tires 41, 42 are positioned herein.

The reinforcing member 20 is configured to take such a shape as to have a plurality of (four in a four-wheeled vehicle) wheel houses 23 and 24 for storing a front tire 41 and a rear tire 42 respectively. The four wheel houses 23 and 24 of the reinforcing member 20 are fitted in cut portions 11 formed on the body 10 along curves of the wheel houses 23 and 24 and thus come in contact with the body 10.

In the present embodiment, the four wheel houses 23 and 24 have screw fastening holes 25F and 25R on respective top parts (in the vicinity of vertexes of curves). In this example, a screw fastening hole 25F is provided on each of the left and right wheel houses 23 for the front tire 41, and a screw fastening hole 25R is provided on each of the left and right wheel houses 24 for the rear tire 42. All of these screw fastening holes 25F and 25R take cylindrical shapes having small heights and are through holes.

Moreover, the body 10 has a plurality of screw fastening holes 15F and 15R corresponding to the screw fastening holes 25F and 25R provided in the reinforcing member 20, respectively. In other words, the screw fastening hole 15F is provided in a position where each of the left and right wheel houses 23 for the front tire 41 are stored, and the screw fastening hole 15R is provided in a position where each of the left and right wheel houses 24 for the rear tire 42 is stored. All of these screw fastening holes 15F and 15R are stop holes.

Consequently, the reinforcing member 20 has the wheel houses 23 and 24 fitted in the cut portion 11 of the body 10. Moreover, the reinforcing member 20 is fixed to the body 10 with a plurality of fixing screws 52 in positions of the wheel houses 23 and 24 by insertion of a plurality of fixing screws 52 into screw fastening holes 25F and 25R of the reinforcing member 20 and screw fastening holes 15F and 15R of the body 10.

Figure 3:
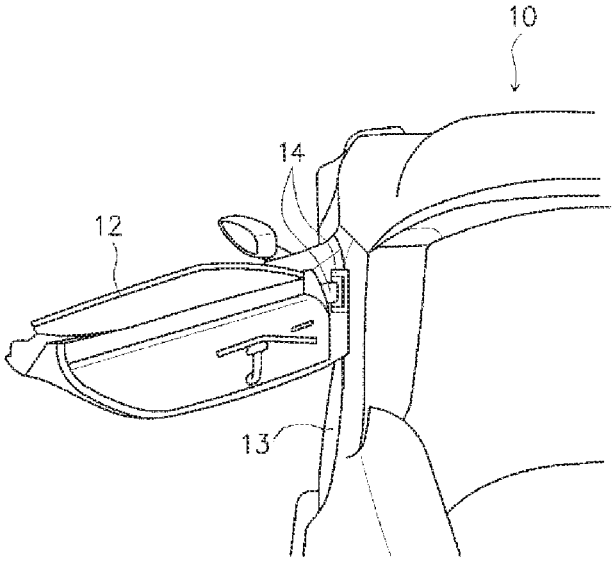
FIG. 3 is a view showing an example of a structure for openably attaching a door to a body according to the present embodiment.

In the present embodiment, left and right doors 12 are openably attached to the body 10. FIG. 3 is a view showing an example of a structure for openably attaching the door 12 to the body 10. As shown in FIG. 3, in the present embodiment, the door 12 is openably attached to the body 10 with a pair of hinges 14 provided on the body 10 side and the door 12 side. The attaching method using the hinge 14 is only illustrative and the door 12 may be attached openably to the body 10 by the other methods.

Referring to a length in a longitudinal direction, the reinforcing member 20 is configured to have such a size as to include a range from a region on a front side in which a front tire 41 is present to a region on a rear side in which a rear tire 42 is present. Referring to a width in a transverse direction, moreover, the reinforcing member 20 is configured to have such a size as to include a range from a region in which a tire on a left side is present to a region in which a tire on a right side is present. By taking the shape, the reinforcing member 20 closes an almost whole region of a lower surface opening part of the body 10 when it is attached to the body 10.

Figure 4:
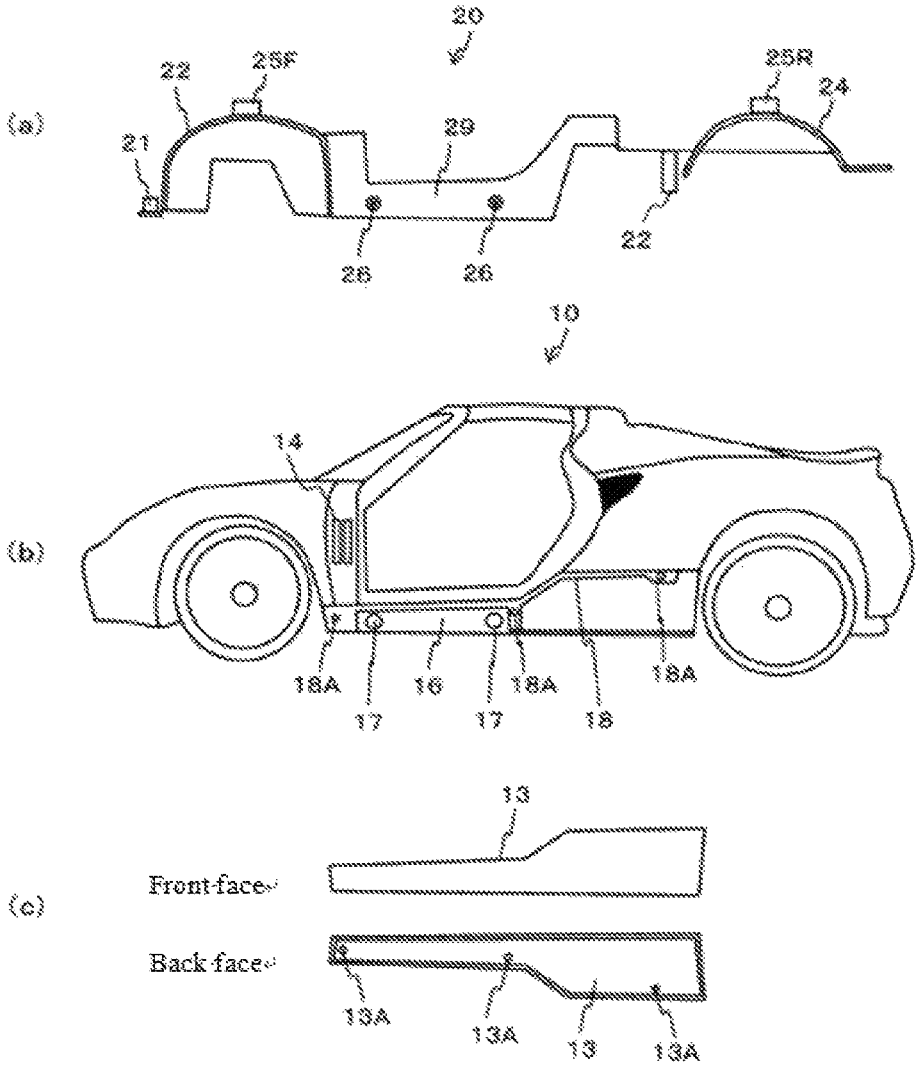
FIG. 4 is a view showing an example of a structure for fixing the bottom portion of the body to the frame portion of the reinforcing member and a structure for fixing the side sill member to the body according to the present embodiment.

Moreover, the reinforcing member 20 has a frame portion 29 to which the bottom portion 16 positioned under the door 12 of the body 10 is to be fixed. FIGS. 4(*a*) and 4(*b*) are views showing an example of a structure for fixing the bottom portion 16 of the body 10 to the frame portion 29 of the reinforcing member 20 according to the present embodiment.

As shown in FIGS. 4(*a*) and 1, the frame portion 29 is present in a position on an inside of an outermost position in a transverse direction of the wheel houses 23 and 24. On the other hand, as shown in FIGS. 4(*b*) and 2, the bottom portion 16 positioned under the left and right doors 12 of the body 10 are provided in inside positions from a position in the car width direction of the lowest part of the door 12 so as to abut on the frame portion 29 when the reinforcing member 20 is attached to the body 10. In other words, the bottom portion 16 corresponds to a side wall of a space taking an inward recessed shape from the position of the lowest part of the door 12. Outermost positions in a transverse direction of the wheel houses 23 and 24 are almost the same as a position in the car width direction of the lowest part of the door 12.

Thus, the body 10 is configured to take a shape having the bottom portion 16 and the reinforcing member 20 is configured to take a shape having the frame portion 29. When the reinforcing member 20 is attached to the body 10, consequently, the left and right frame portions 29 of the reinforcing member 20 abut on the left and right bottom portions 16 of the body 10. The frame portion 29 has a structure of a sill erected in a certain height so as to increase an area on which the bottom portion 16 is to abut.

A plurality of screw fastening holes 26 is provided on the frame portion 29. Each of the screw fastening holes 26 serves as a cylindrical stop hole having a small height. Moreover, a plurality of screw fastening holes 17 is provided in positions which are coincident with the screw fastening holes 26 possessed by the frame portion 29 in the bottom portion 16, respectively. The screw fastening hole 17 is a through hole having a slightly larger diameter than the diameter of the screw fastening hole 26 of the frame portion 29. By insertion of the screw fastening hole 26 (stop hole) of the frame portion 29 into the screw fastening hole 17 (through hole) of the bottom portion 16 to fix a plurality of fixing screws 53 to the screw fastening hole 26, the bottom portion 16 is fixed to the frame portion 29.

As shown in FIGS. 1 and 2, the side sill member 13 for covering the bottom portion 16 is provided under the door 12 of the body 10. The side sill means a sill of a side surface and represents a member provided directly under the left and right doors 12. When the bottom portion 16 is screwed to the frame portion 29 as shown in FIGS. 4(*a*) and 4(*b*), there is brought a state in which a head of the fixing screw 53 is seen from an outside. The side sill member 13 is attached to the outside of the bottom portion 16 in order to hide the bottom portion 16 including the fixing screw 53.

FIGS. 4(*b*) and 4(*c*) are views showing an example of a structure for fixing the side sill member 13 to the body 10 according to the present embodiment. As shown in FIGS. 4(*b*) and 2, a side sill receiving portion 18 is provided in an inside position from the position in the car width direction of the lowest part of the door 12. In the same manner as the bottom portion 16, the side sill receiving portion 18 also corresponds to a side wall of a space recessed inward from the position of the lowest part of the door 12.

A depth of the dent is smaller in the side sill receiving portion 18 than in the bottom portion 16. The depth of the dent of the side sill receiving portion 18 is almost equal to a thickness of the side sill member 13. When the side sill member 13 is fixed to the side sill receiving portion 18, consequently, an external surface of the side sill member 13 is aligned with that of the body 10 around a position where the side sill member 13 is fixed.

As shown in FIG. 4(*b*), a plurality of fastening holes 18A is provided on the side sill receiving portion 18. On the other hand, as shown in FIG. 4(*c*), a plurality of projections 13A is provided in positions which are respectively coincident with a plurality of fastening holes 18A possessed by the side sill receiving portions 18 on a back face of the side sill member 13. By fitting the projection 13A in the fastening hole 18A, it is possible to fix the side sill member 13 to the side sill receiving portion 18.

Figure 5:
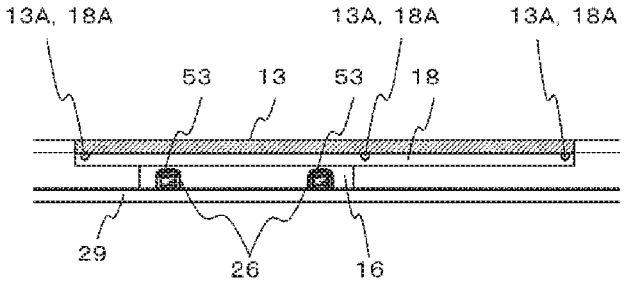
FIG. 5 is a view showing a state in which the bottom portion of the body is screwed to the frame portion of the reinforcing member and the side sill member is fixed to the body according to the present embodiment.

FIG. 5 is a view showing a state in which the bottom portion 16 of the body 10 is screwed to the frame portion 29 of the reinforcing member 20 and the side sill member 13 is fixed to the body 10 according to the present embodiment. As shown in FIG. 5, the bottom portion 16 abuts on the frame portion 29 when the reinforcing member 20 is attached to the body 10. At this time, the screw fastening hole 26 (the stop hole) of the frame portion 29 is inserted into the screw fastening hole 17 (through hole) of the bottom portion 16. The fixing screws 53 are fixed to the screw fastening holes 26 so that the bottom portion 16 is fixed to the frame portion 29. Moreover, the projections 13A provided on the back face of the side sill member 13 are fitted in the fastening holes 18A provided on the side sill receiving portion 18 so that the side sill member 13 is fixed to the side sill receiving portion 18.

Although the description has been given to the structure in which the depth of the dent of the side sill receiving portion 18 is set to be smaller than that of the dent of the bottom portion 16, the depths of both dents may be set to be equal to each other. In this case, by increasing the length of the projection 13A of the side sill member 13, it is possible to fix the side sill member 13 to the side sill receiving portion 18 in a state in which the external surface of the side sill member 13 is aligned with that of the body 10 around the position where the side sill member 13 is fixed.

In the present embodiment, the body 10 and the chassis 30 which are exterior parts of a car are formed of a resin. A fine part of the resin can be processed much more easily than a metal. For this reason, original models of the body 10 and the chassis 30 are mass-produced by a mold, and subsequently, the fine part can easily be processed really to imitate an authentic car by a manual work.

In the present embodiment, moreover, the reinforcing member 20 has such a structure as to include a seat housing portion 27 for accommodating a seat (not shown) and a dashboard installing portion 28 for installing a dashboard (not shown). By attaching a seat and a dashboard which are formed of a resin to the seat housing portion 27 and the dashboard installing portion 28, for example, it is also possible to really reproduce interior decors of the car in order to intimate an authentic car.

As described above, the bottom portion 16 positioned under the door 12 abuts on the frame portion 29 of the reinforcing member 20 provided on an inside of the body 10 and is fixed with the fixing screw 53. Even though in the case in which the bottom portion 16 is molded to be expanded outward at the step of manufacturing the body 10, the bottom portion 16 is fixed to the frame portion 29 of the reinforcing member 20 with the screw 53. Therefore, the bottom portion 16 positioned under the door 12 reliably abuts on the reinforcing member 20 formed of a metal. For this reason, it is possible to prevent the body 10 (particularly, the bottom portion 16 and the side sill member 13 portion covering the bottom portion 16) from being flexed inward by force generated when the door 12 is closed. Consequently, the side sill member 13 portion is flexed with difficulty when the door 12 is to be opened/closed. Thus, it is possible to exhibit the opening/closing stability related to the door 12.

As described above, in the present embodiment, the reinforcing member 20 formed of a metal is fixed to the body 10 formed of a resin. Therefore, it is possible to cause the body 10 to be flexed with difficulty by the reinforcing member 20 formed of a metal even through the body 10 is molded by a resin in order to easily enable processing of a fine part.

In the present embodiment, particularly, the reinforcing member 20 is configured to take such a shape as to include the four wheel houses 23 and 24, and the wheel houses 23 and 24 are fitted in the cut portions 11 of the body 10. Furthermore, the reinforcing member 20 is fixed to the body 10 with the fixing screws 52 in the positions of the wheel houses 23 and 24. Consequently, it is possible to employ a structure in which the body 10 formed of a resin is flexed with extreme difficulty.

In the present embodiment, moreover, the frame portion 29 is provided in the reinforcing member 20 so that the frame portion 29 is caused to abut on the bottom portion 16 of the body 10, and furthermore, the bottom portion 16 is fixed to the frame portion 29 through screwing. The side sill member 13 is attached to cover the screwed bottom portion 16. Consequently, it is possible to ensure a necessary rigidity strength for the side sill member 13 portion. Therefore, the side sill member 13 portion is flexed with difficulty when the door 12 is to be opened/closed. Thus, it is possible to exhibit the opening/closing stability related to the door 12.

In the case in which an opening/closing portion such as the door 12 is attached with the hinges 14 to the body 10 that is formed of a resin and is apt to be flexed without any reinforcement as shown in FIG. 3, consequently, it is possible to exhibit opening/closing stability by avoiding a state in which the door 12 is not closed properly due to the flexure of the body 10. Moreover, the reinforcing member 20 is made of a metal and is formed to be comparatively large in order to close an almost whole region of the lower surface opening part of the body 10. For this reason, it is also possible to exhibit a massive feeling when a user holds the car type model in a hand.

Although the description has been given to the example in which the reinforcing member 20 includes the four wheel houses 23 and 24 on front, rear, left and right parts and is fixed to the body 10 with the fixing screw 52 in the wheel house 23 and 24 portions in the embodiment, the present invention is not restricted thereto. For example, the reinforcing member 20 may be fixed to the body 10 with screwing in portions other than the wheel houses 23 and 24. In this case, the reinforcing member 20 is not necessarily configured to take such a shape as to have the wheel houses 23 and 24.

For example, the reinforcing member 20 can also be configured by a flat plate formed of a metal. However, the reinforcing member 20 is preferably configured to take such a shape as to have the wheel houses 23 and 24 and thus fixed to the body 10 in the wheel house 23 and 24 portions in that it is possible to have a structure in which the body 10 and the reinforcing member 20 come in contact with each other in a larger area and the body 10 is flexed with more difficulty.

As another example, it is also possible to have a structure in which the reinforcing member 20 includes only the wheel house 23 for the front tire 41 or a structure in which the reinforcing member 20 includes only the wheel house 24 for the rear tire 42. In this case, it is possible to fix the reinforcing member 20 to the body 10 with the fixing screw 52 in the wheel house 23 and 24 portions.

In order to exhibit the stability in the opening/closing operations of the door 12, furthermore, it is sufficient that at least the side sill member 13 portion is flexed with difficulty. Accordingly, it is sufficient that the reinforcing member 20 has such a structure as to have at least the frame portion 29 which is to abut on the bottom portion 16 which is covered by the side sill 13.

In addition to the reinforcing member 20 or the reinforcing member (corresponding to a first reinforcing member) according to the variant, moreover, it is also possible to further include a second reinforcing member configured to take a shape along an internal surface of a roof of the body 10. Consequently, the lower surface side of the body 10 (the chassis 30 side) can be mainly reinforced by the first reinforcing member and the upper surface side of the body 10 can be mainly reinforced by the second reinforcing member so that the body 10 can be flexed with more difficulty.

Although the description has been given to the example in which the chassis 30 is formed of a resin in the embodiment, moreover, the present invention is not restricted thereto. For example, the chassis 30 may be formed of a metal to exhibit a massive feeling more greatly. As an ornamental minicar, a fine part at the back side of the chassis 30 is also processed to intimate an authentic car in some cases. In consideration of easiness of the processing, therefore, it is preferable that the chassis 30 should be formed of a resin. Depending on a type of a car, however, the back side of the chassis of the authentic car does not have a very complicated structure and the chassis 30 can be manufactured by simple processing in some cases. In the case of this type of a car, the chassis 30 can be formed of a metal.

Although the description has been given to the example in which the reinforcing member 20 is configured to have such a size as to include the almost whole region of the vehicle length (the length in the longitudinal direction) and that of the vehicle width (the length in the transverse direction) in the embodiment, moreover, the present invention is not restricted thereto. For example, as shown in FIG. 6, a reinforcing member 20' may be configured to have such a size as to include at least the almost whole region of the vehicle width and the frame portion 29 may be provided in the reinforcing member 20'.

Figure 6:
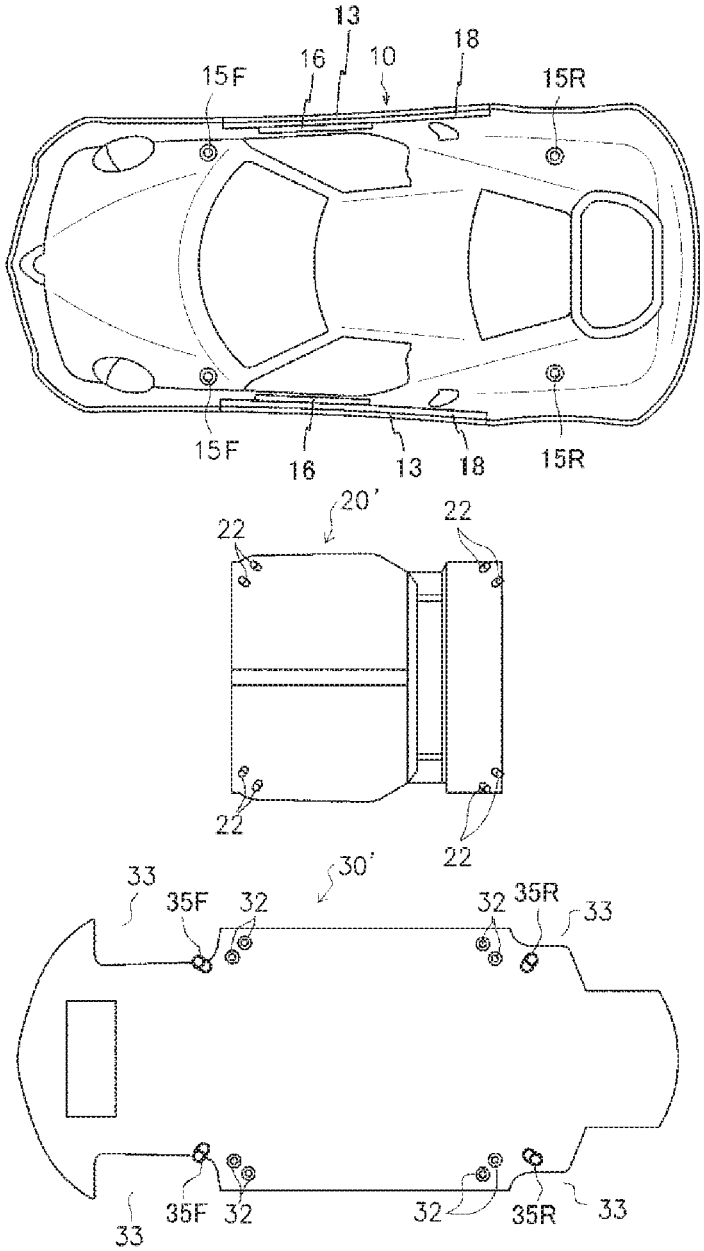
FIG. 6 is a view showing a state in which a body, a reinforcing member and a chassis in a minicar are seen from a back face according to a variant of the present embodiment.

In the example of FIG. 6, the reinforcing member 20' is provided with a plurality of screw fastening holes 22 (stop holes) in positions corresponding to four corners thereof. On the other hand, a chassis 30' has no screw fastening hole 31 shown in FIG. 2 but is provided with a plurality of screw fastening holes 32 (through holes) in positions which are matched with the screw fastening holes 22 included in the reinforcing member 20' respectively. The chassis 30' is fixed to the reinforcing member 20' with a plurality of fixing screws 51 through the screw fastening holes 22 and 32.

Moreover, the chassis 30' has a plurality of screw fastening holes 35F and 35R (all of which are through holes having great heights and cylindrical shapes) provided in positions that are matched with the screw fastening holes 15F and 15R (stop holes) included in the body 10 respectively. The chassis 30' is fixed to the body 10 with a plurality of fixing screws (having greater lengths than the fixing screw 52 shown in FIG. 1) through the screw fastening holes 15F and 15R and the screw fastening holes 35F and 35R.

The method of fixing the body 10, the reinforcing member 20' and the chassis 30' shown in FIG. 6 (the screw fastening positions) is only illustrative and the present invention is not restricted thereto.

Although the description has been given to the example in which the body 10, the reinforcing members 20 and 20' and the chassises 30 and 30' are fixed with the fixing screws in the embodiment, furthermore, the present invention is not restricted thereto. For example, they may be fixed with an adhesive. Alternatively, the concavo-convex structures such as the projection 13A and the fastening hole 18A shown in FIG. 4 may be provided to fit a convex portion in a concave portion, thereby fixing them to each other. As a further example, a hook structure taking a click shape may be provided to engage two members with use of the hook structure, thereby fixing them. The concavo-convex structure and the hook structure correspond to an engaging portion according to claims.

In the embodiment, moreover, the description has been given to the structure in which the frame portion 29 of the reinforcing member 20 is present in the position on the inside of the outermost position in the transverse direction of the wheel houses 23 and 24 (almost the same position as the position in the car width direction of the lowest part of the door 12). In this case, the bottom portion 16 of the body 10 is provided in an inside position from the position of the lowermost part of the door 12 in such a manner that the bottom portion 16 of the body 10 abuts on the frame portion 29, and the side sill member 13 is attached to cover the bottom portion 16. However, the present invention is not restricted to such a structure.

Figure 7:
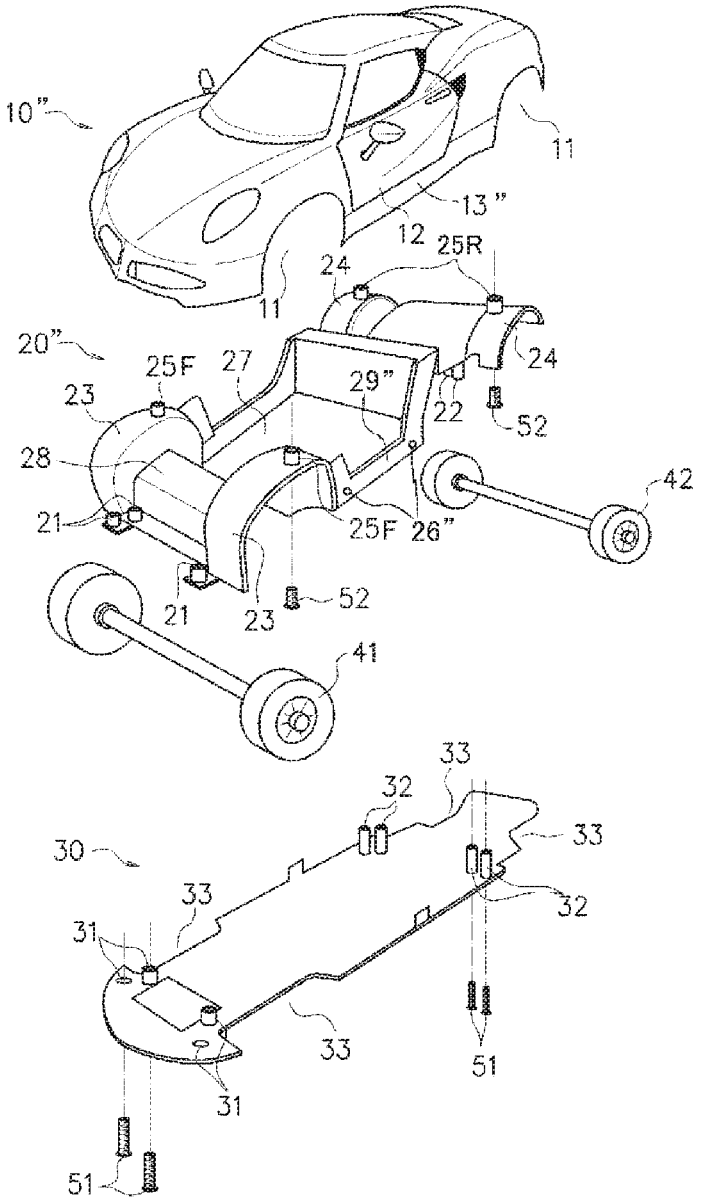
FIG. 7 is a view showing an example of another structure for fixing the body to the reinforcing member according to the present embodiment.
Figure 8:
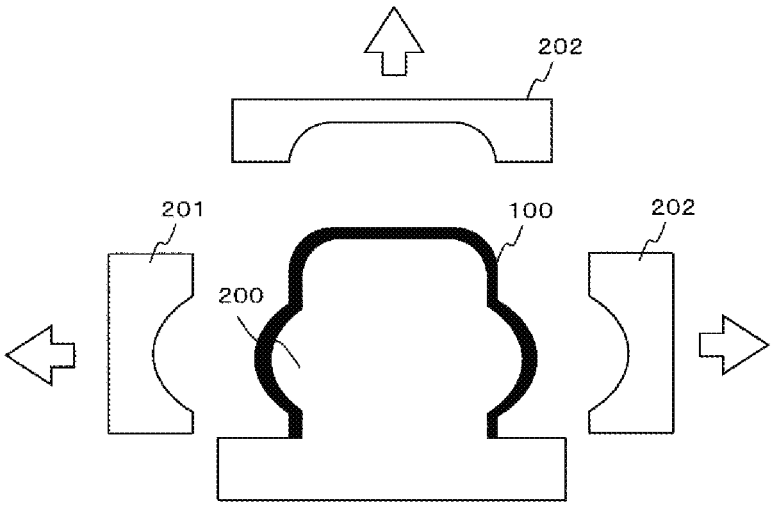
FIG. 8 is a view showing a process in which the shape of the bottom area is deformed outward at the step of manufacturing the body.
Figure 8:
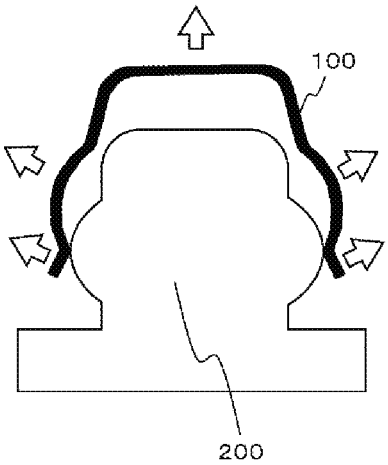

For example, as shown in FIG. 7, it is also possible to employ a structure in which a frame portion 29" of a reinforcing member 20" is present in almost the same position as the outermost position in the transverse direction of the wheel houses 23 and 24. In this case, it is not necessary to configure the bottom portion 16 so as to be positioned on the inside of the position of the lowest part of the door 12. Moreover, the side sill member 13 does not need to be configured as a separate member from the body 10 and a side sill 13" may be molded integrally with a body 10". In this case, the side sill 13" corresponds to the bottom portion according to the claims.

In case of the structure shown in FIG. 7, when a through hole is provided on the side sill 13" and the side sill 13" is fixed to the frame portion 29" by insertion of the fixing screw into the through hole, the head of the fixing screw is exposed outward from the side sill 13", which is not apparently preferable. Therefore, it is preferable to provide an engaging portion for engaging the side sill 13" (a bottom portion) with the frame portion 29" in each of an internal surface of the side sill 13" of the body 10" and an external surface of the frame portion 29" of the reinforcing member 20". As an example of the engaging portion, it is possible to use a structure in which a plurality of fastening holes 26" is provided on the external surface of the frame portion 29" and a plurality of projections (not shown) is provided in opposed positions to a plurality of fastening holes 26" respectively over a back face of the side sill 13" as shown in FIG. 7.

Moreover, the shapes of the body 10 and 10", the reinforcing members 20, 20' and 20" and the chassises 30 and 30' described in the embodiment are only illustrative and it is apparent that the shapes are varied depending on a vehicle type.

In addition, the embodiment is only illustrative for concreteness to carry out the present invention and the technical scope of the present invention should not be thereby construed to be restrictive. In other words, the present invention can be carried out in various configurations without departing from the gist or main features thereof.

EXPLANATION OF DESIGNATION

10, 10" body
11 cut in which wheel house is accommodated
12 door
13 side sill member
13" side sill (bottom portion)
14 hinge
16 bottom portion
17 screw fastening hole
20, 20', 20" reinforcing member
21, 22 screw fastening hole
23, 24 wheel house
25F, 25R screw fastening hole
26 screw fastening hole
26" fastening hole (engaging portion)
27 seat housing portion
28 dashboard installing portion
29, 29" frame portion
30, 30' chassis
31, 32 screw fastening hole
33 cut in which tire is accommodated

The invention claimed is:

1. A car type model comprising (a) a body formed by a resin to which left and right doors are hingedly attached for opening and closing;

(b) a reinforcing member which is formed of a metal and is detachably attachable to an inside of the body; and (c) a chassis that is detachably attachable to the reinforcing member;

wherein the body comprises left and right bottom portions disposed under the left and right doors, each of the left and right bottom portions comprising an elongate side surface;

wherein the reinforcing member comprises left and right frame portions with each comprising an elongate side surface;

wherein the respective elongate side surfaces of the left and right bottom portions of the body abut the elongate side surfaces of the left and right frame portions with the reinforcing member detachably attached to the body;

wherein the respective side surfaces of the elongate left and right frame portions collectively comprise a first set of screw holes and the elongate left and right bottom portions of the body collectively comprise a second set of screw holes, wherein the first set of screw holes and the second set of screw holes align with each other when the reinforcing member is detachably attached to the body, and wherein the respective first and second sets of screw holes are configured and arranged such that, with a plurality of screws screwed through the aligned screw holes in the respective side surfaces of the left and right body portions and the left and right frame portions, the left and right bottom portions are inhibited from flexing when the left and right doors are opened and closed.

2. The car type model according to claim 1, wherein the car type model further comprises first and second members that are detachably attachable to the respective elongate side surfaces of the left and right bottom portions to cover from view the second set of screw holes in the respective elongate side surfaces of the left and right bottom portions and screws inserted therein.

3. The car type model according to claim 2, wherein the left and right bottom portions of the body and the first and second members collectively comprise first means for detachably attaching the first and second members to the respective elongate side surfaces of the left and right bottom portions.

4. The car type model according to claim 3, wherein the first means comprise fastening holes on the respective left and right bottom portions and projections on respective back faces of the first and second members.

5. The car type model according to claim 2, wherein the reinforcing member is detachably attachable to the inside of the body by second means consisting of screw holes and screws insertable from underneath the body and wherein the chassis is detachably attachable to the reinforcing member by means consisting of screw holes and screws insertable from underneath the reinforcing member.

6. The car type model according to claim 5, further comprising a plurality of screws for insertion through the first and second sets of screw holes.

7. The car type model according to claim 2, wherein the reinforcing member has a left front wheel house, a right front wheel house, a left rear wheel house and a right rear wheel house, wherein the left and right frame portions are disposed between the left front and left rear wheelhouses and the right front and right rear wheelhouses respectively along opposing peripheries of the reinforcing member and wherein, with the reinforcing member attached to the inside of the body and the chassis attached to the reinforcing member, the elongate side surfaces of the left and right frame portions are disposed transverse to the chassis.

* * * * *